United States Patent [19]

Brouillette et al.

[11] Patent Number: 5,016,344

[45] Date of Patent: May 21, 1991

[54] METHOD FOR CONSTRUCTING A MINIATURE DUAL IN-LINE PACKAGE ELECTRICAL SWITCH

[75] Inventors: Peter Brouillette, Manchester, N.H.; Salvatore D. Ciufetti, Fitchburg, Mass.

[73] Assignee: Augat, Inc., North Andover, Mass.

[21] Appl. No.: 531,235

[22] Filed: May 31, 1990

Related U.S. Application Data

[62] Division of Ser. No. 451,371, Dec. 25, 1989, Pat. No. 4,975,543.

[51] Int. Cl.[5] ..... H01H 11/00

[52] U.S. Cl. ..... 29/622; 29/412; 264/242

[58] Field of Search ..... 29/622, 412, 415; 264/242, 250, 264; 200/5 R, 6 R, 6 B, 6 BB, 339

[56] References Cited

U.S. PATENT DOCUMENTS

| | | | |
|---|---|---|---|
| 2,882,648 | 4/1959 | Hovgaard et al. | 29/622 |
| 3,907,959 | 9/1975 | Wise et al. | 264/242 |
| 4,311,884 | 1/1982 | Henley et al. | 200/6 R |
| 4,352,964 | 10/1982 | English | 29/622 |
| 4,417,106 | 11/1983 | Gingerich et al. | 200/6 R |

FOREIGN PATENT DOCUMENTS

| | | | |
|---|---|---|---|
| 177518 | 9/1985 | Japan | 264/250 |

*Primary Examiner*—P. W. Echols

*Attorney, Agent, or Firm*—Pearson & Pearson

[57] ABSTRACT

A method for constructing a multiple-pole switch of the dual in-line package type initially manufacturing a base unit with integral terminals and a cavity for each pole. A movable contact having first and second end portions and intermediate portions are deposited in each cavity. A double-injection molding process produces a rotatable actuator and a cover that is assembled onto the base unit to capture the movable contacts in their corresponding cavities.

4 Claims, 3 Drawing Sheets

Fig. 4
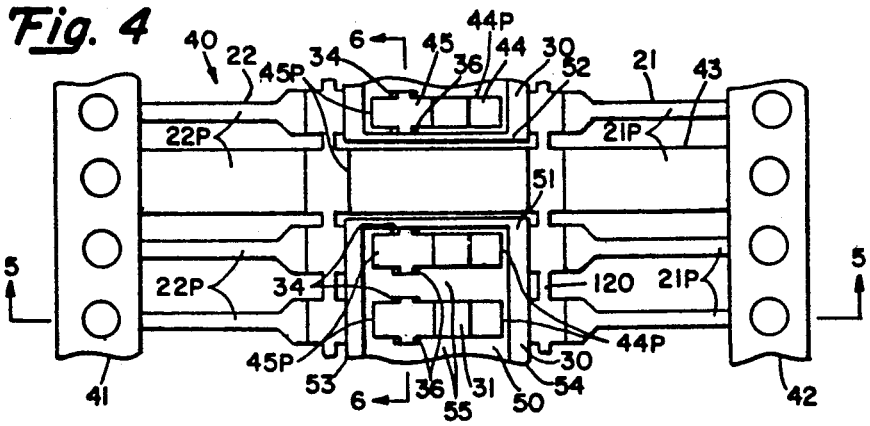
Fig. 5
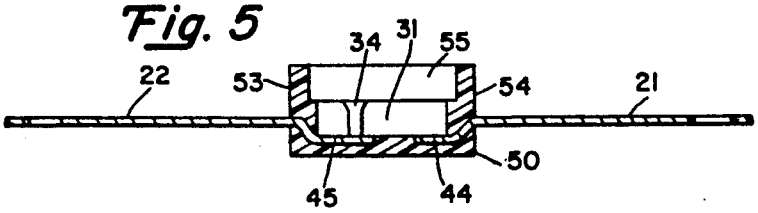
Fig. 6
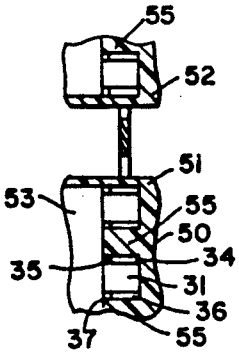
Fig. 7
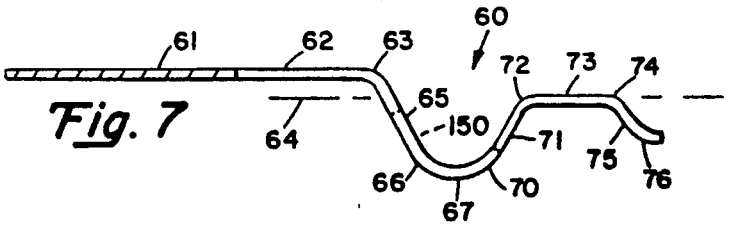
Fig. 8
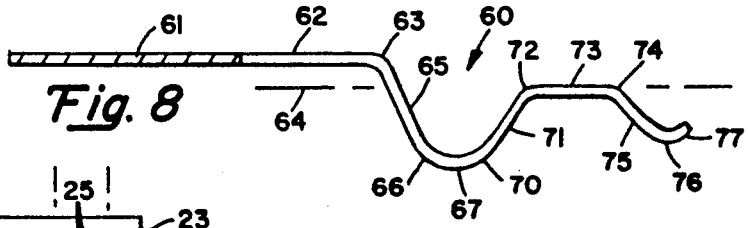
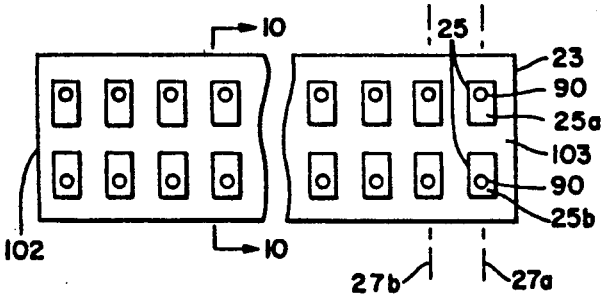
Fig. 9
Fig. 10
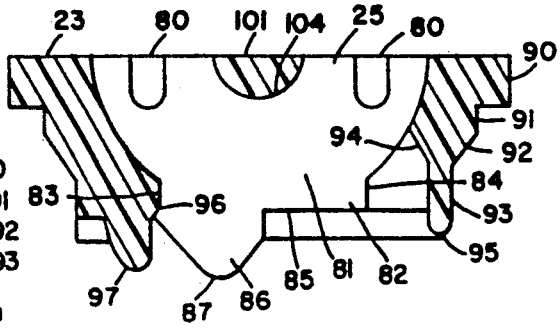
Fig. 11
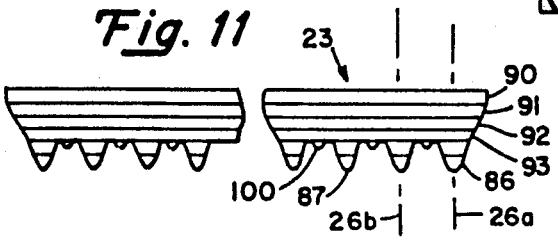

Fig. 12
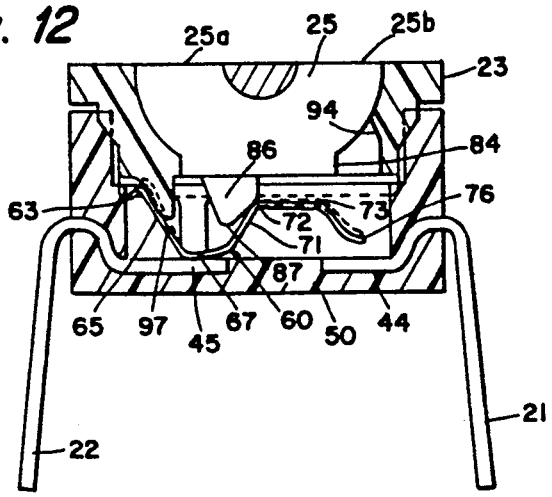
Fig. 13
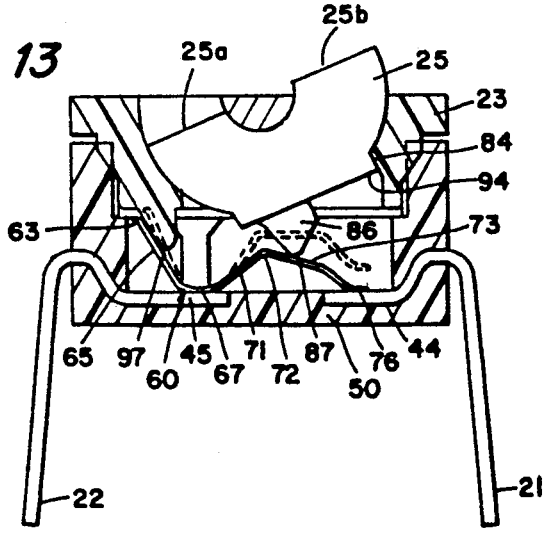
Fig. 14
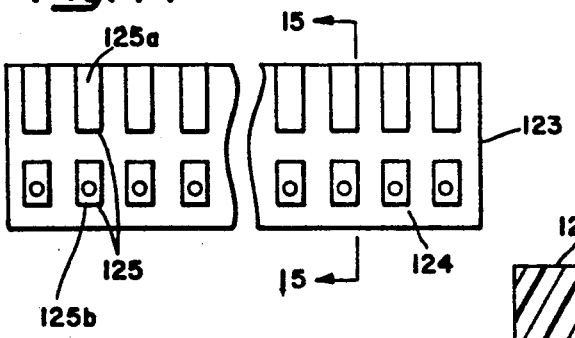
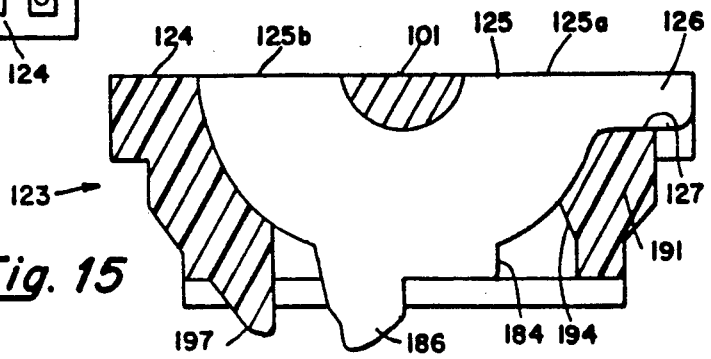
Fig. 15

METHOD FOR CONSTRUCTING A MINIATURE DUAL IN-LINE PACKAGE ELECTRICAL SWITCH

RELATED APPLICATION

This application is a division of our application Ser. No. 07/451,371, filed Dec. 15, 1989, now U.S. Pat. No. 4,975,548 entitled "MINIATURE DUAL IN-LINE PACKAGE ELECTRICAL SWITCH".

BACKGROUND OF THE INVENTION

1. Field of the Invention

This invention generally relates to electrical switching devices and more particularly to multiple pole switching devices of the dual in-line package type.

2. Description of Related Art

Dual in-line package (DIP) switches have many applications, particularly in electronic circuitry used in digital data processing systems and like products. DIP switches comprise a plurality of single-pole, single-throw switching mechanisms physically located in a unitary package. Two parallel rows of terminals, or terminal pins, connect switching mechanisms inside the package to circuits on a printed circuit board. Each switching mechanism makes or breaks a circuit between a pair of terminals constituted by a corresponding terminal in each row.

Typically a DIP switching mechanism comprises at least one stationary contact inside the switch package. Usually this contact is formed integrally with a first terminal. A movable contact inside the package may be constructed integrally with the second terminal. It may also be independent and engage a second stationary contact that is integral with the second terminal. An actuating mechanism is accessible to an operator and shifts the movable contact to make or break a conductive path between the corresponding terminals. Normally this occurs when the actuating mechanism overcomes a bias that forces the movable contact to an open circuit condition.

Over time certain DIP switch characteristics have become required or desireable. For example, it is very desirable that actuator movement be accompanied by a definite detent action to assure an operator that the switch either is open or closed (i.e., is "off" or "on"). DIP switches should be small to increase component denstiy. They must be reliable and easy to use. Finally, they should be inexpensive to manufacture. A number of switch constructions have been proposed in an attempt to provide all of these characteristics.

U.S. Letters Pat. No. 3,291,951, for example, discloses a miniature single-pole, double-throw switch. A common movable contact rotates to make an electrical connection with one of two stationary contacts. A slot in a rotary actuator indicates which switching connection has been made.

U.S. Letters Pat. No. 3,900,709 discloses a multiple switch assembly having independent operators that rotatably cam discrete leaf spring type contact assemblies. In this switching device, a first terminal and stationary contact are formed as an integral assembly. A second contact is formed on a transverse extension to a second terminal. The terminal and extension are manufactured such that there is a spring bias exerted to separate the two contacts. Turning a rotary actuator cams it along a vertical axis to overcome the bias of the second contact and displaces it into connection with the first contact. A slot in the rotary actuator and a detent indicate switch operation. A radially extending pin on the actuator engages a recesses in the opened and closed positions to provide the detent operation.

U.S. Letters Pat. No. 3,944,760 discloses a switch assembly having an insulating slider actuator inserted between normally closed contacts. Each of two terminals extends into a switching cavity and bends to provide overlying relationship between the contacts. One of the contacts is biased into contact with the other. A slide, cantilevered around the other contact, moves between the two contacts to separate them and open the switch. In the other position, the insulating slide is removed so the contacts make an electrical connection. A cam surface on the end of the slider passes over an acutely formed can follower on the movable contact to provide a detent.

U.S. Letters Pat. No. 4,117,280 discloses a miniature DIP switch utilizing a rocker actuator. A first terminal and integral stationary contact are inside a switching cavity. A second terminal has a long cantilevered arm with a contact at its free end. Internal stresses in the second contact normally maintain an open-circuit condition. The rocker actuator has a depending cam surface that moves against a cam follower portion on the second contact. This forces the contacts into electrical connection. Over-center springs between the base unit and the rocker provide a detent action.

U.S. Letters Pat. No. 4,119,823 also discloses an electrical switch of the dual in-line package type. Each of two terminals extending from the switch end into overlapping contacts inside a switching cavity. When a rotary actuator moves from an opened to a closed position, it cams one contact into the other. The camming surface rides over a curved contact portion to provide a detent.

U.S. Letters Pat. No. 4,412,108 discloses a switch having two terminals extending into a switching cavity with spaced stationary contacts. A movable contact pivots on a first stationary contact to produce an electrical connection with the second contact. A rocker actuator with a spring-biased cam moves to opposite sides of the movable contact pivot during switching operations. When the cam is on the same side of the pivot as the second contact, it forces the movable contact into an electrical connection. An embossment on the movable contact at the pivot point forces the cam upward as the cam passes over the pivot. Then the cam extends as it passes over this embossment to provide a detent action.

Each of these references, taken singly or in combination, provide various switching mechanism that are characterized by overly complex actuators, contact arrangements that are difficult to manufacture or an excessive number of components. In some, manufacturing tolerances must be tightly controlled to maintain switch operation and this can increase manufacturing costs.

Therefore, it is an object of this invention to provide a switching device of the dual in-line package type that is particularly adapted for electronics applications.

Another object of this invention is to provide a switching device of the dual in-line package type with improved reliability achieved through a reduction in a number of components.

Still another object of this invention is to provide a switching device of the dual in-line package type in which manufacturing is simplified by reducing the number of components.

Still another object of this invention is to provide a switching device of the dual in-line package type in which modular construction techniques can be used to simplify manufacturing, reduce manufacturing costs and minimize inventory requirements.

SUMMARY

In accordance with this invention each pole in a multiple pole switching device of the dual in-line package type includes an insulating base unit with first and second conductive terminal means. Each terminal means includes an external terminal section and an internal stationary contact. The contacts are disposed in a cavity of the base unit. Movable contact means in the form of a single spring element are disposed in the cavity with a first intermediate portion engaging the first stationary contact section and a second end portion adapted for engagement with the second contact portion but normally spaced therefrom. A cover, including an integrally formed actuator means, captures a first end of the movable contact means. The actuator means includes a rotatable cam that contacts a second intermediate portion of the movable contact means to force it into or release it from contact with the second stationary contact. The depending cam further rides over a radiused portion of the intermediate portion of the movable contact to provide a detent when the switch moves between the on and off positions.

BRIEF DESCRIPTION OF THE DRAWINGS

This invention is pointed out with particularity in the appended claims. The various objects, advantages and novel features of this invention will be more fully apparent from a reading of the following detailed description in conjunction with the accompanying drawings in which like reference numerals refer to like parts, and in which:

FIG. 4 is a plan view showing a base unit utilized in the electrical switching device of FIG. 1;

FIG. 5 is a section view taken along lines 5—5 in FIG. 4;

FIG. 6 is a section view taken along lines 6—6 in FIG. 4;

FIG. 7 is a side view of a movable contact constructed in accordance with this invention;

FIG. 8 is a side view of an alternative embodiment of the movable contact shown in FIG. 7;

FIG. 9 is a top plan view of a cover-actuator assembly utilized in the switching device of FIG. 1;

FIG. 10 is an enlarged section view taken along lines 10—10 of FIG. 9;

FIG. 11 is a front view of the cover-actuator section shown in FIG. 9,

FIG. 12 is a cross-sectional view of a switching device constructed in accordance with this invention in the "off" position;

FIG. 13 is a cross-section view of a switching device constructed in accordance with this invention in the "on" position;

FIG. 14 is a plan view of an alternative cover-actuator that can be utilized in the electrical switching device of FIG. 1; and FIG. 15 is an enlarged section view taken along lines 15—15 of FIG. 14.

DESCRIPTION OF ILLUSTRATIVE EMBODIMENTS

Figure 1:
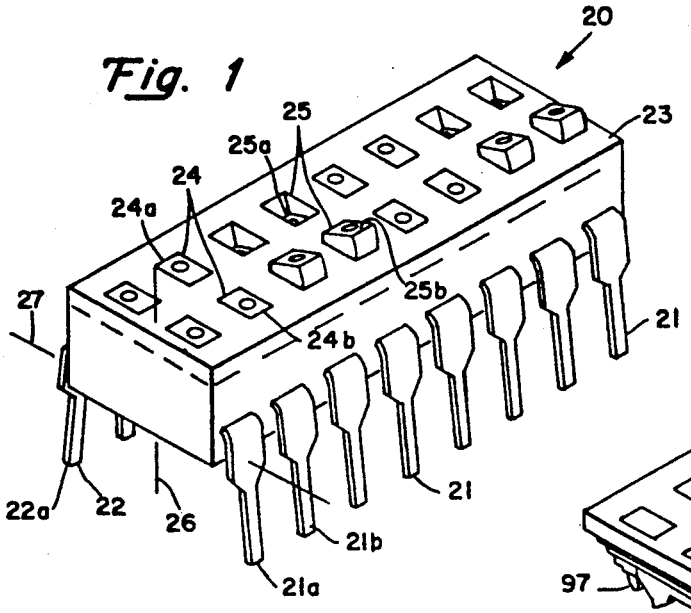
FIG. 1 is a perspective view of a dual in-line package switch constructed in accordance with this invention.

FIG. 1 discloses an eight-pole single-throw switching device of the dual in-line package type (i.e., an eight-pole DIP switch) 20. The DIP switch 20 includes two rows 21 and 22 of eight terminals each. As will become more apparent later, the individual ones of the terminals 21 and 22 connect to stationary contacts located within a cover-actuator assembly 23 and a base unit. The cover-actuator 23 has a number of actuators (eight in this specific embodiment). One actuator 24 has two operating elements in the form of push buttons **24*a* and 24*b* that penetrate the surface of the cover 23. In FIG. 1 the push buttons 24*a* and 24*b* are flush with the cover 23, so that corresponding pole is open. Actuator 25 has a push button 25*a* depressed below the surface of the cover-actuator 23. This forces push-button 25*b* above the surface of the cover-actuator 23. In this position, actuator 25** has closed the switching pole.

FIG. 1 also discloses a vertical axis 26 and a horizontal axis 27 centered on an end actuator and the end terminals **21*a* and 22*a*. The axes 26 and 27** define a pole plane that is useful in understanding the relationship of the various components in the circuit. There is one pole plane for each switch pole. Thus, the eight-pole dip switch is characterized by having eight pole planes.

The DIP switch 20 is compact. Typically the spacing between adjacent terminals (e.g., terminals **21*a* and 21*b*) is 0.10 inches and the spacing between the rows 21 and 22 is 0.30 inches. Although FIG. 1** discloses an eight-pole switch, the switches typically can be manufactured with a larger number of poles. For particular applications, it is merely necessary to slice the switch at a midpoint between adjacent pole planes to obtain a desired number of poles. In computer applications, switches with one, two, four and eight poles are common. In one embodiment, the switches are manufactured as sixteen-pole switches. Dividing such a switch into smaller modules does not disrupt the integrity of the switching device. As a result manufacturing costs are reduced. It is only necessary to tool to manufacture and to inventory one specific switch (i.e., the sixteen-pole DIP switch) to satisfy several switch sizes.

Figure 2:
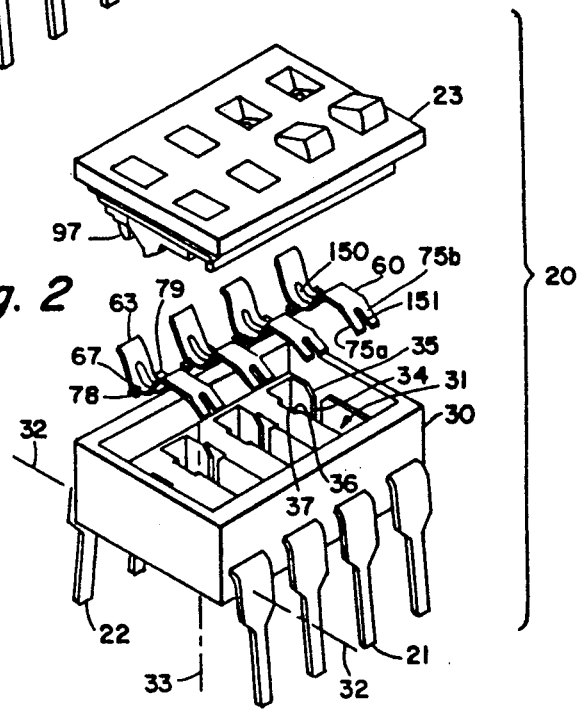
FIG. 2 is an exploded view in perspective of a dual in-line package switch constructed in accordance with this invention.

FIG. 2 is an exploded view of a four-pole DIP switch 20. It discloses the few component sets that are necessary to construct the switch. Specifically, an insulating base unit 30 is a molded structure that is integral with terminals 21 and 22 and contains an individual switching cavity 31 for each pole. For example, axes 32 and 33 represent a pole plane for the left-most pole position in FIG. 2. Corresponding ones of terminals 21 and 22 and a cavity like the cavity 31 are centered on that pole plane.

Each cavity 31 has a slot 34 with a flared opening 35. A corresponding opposed slot 36 with a flared opening 37 is located on the opposite side of the cavity 31.

More specifically the base unit 30 requires two basic manufacturing operations. As disclosed in step 210 of FIG. 3, the first step is the manufacture of a terminal ladder 40, as shown in FIG. 4. The terminal ladder 40 is a stamping of conductive material with side carriers 41 and 42 and a plurality of rungs that form either the terminals and contacts or constitute spacer rungs, such as spacer rung 43. For example, the top most rung between the side carriers 41 and 42 comprises terminals 21 and 22 together with stationary contacts 44 and 45. The contacts 44 and 45 are spaced apart. Areas on the terminals 21 and 22 to such as those identified by reference 21*p* and 22*p*, are plated to facilitate soldering. Other areas, such as those identified by references 44*p* and 45*p* are plated with gold or other plating materials to insure good electrical connections.

Referring to FIG. 5, the stationary contacts 44 and 45 lie in a plane that is parallel to and offset from the plane of the terminals 21 and 22. Referring again to FIG. 4, the terminal ladder 40 will contain a number of such adjacent terminal rungs as a set. The specific number will correspond to the number of poles to be included (e.g., sixteen poles). The spacer rung 43 between adjacent sets stabilizes spacing between the carriers 41 and 42 during manufacture.

Once the terminal ladder 40 of FIG. 4 is available, it is molded into the base unit 30 as indicated by step 211. The resulting product, shown in FIGS. 4 through 6, includes an insulating base section 50. The base section 50, side walls 51 and 52, end walls 53 and 54 and intermediate walls 55 form the individual cavities 31. Slots corresponding to slots 34 and 36 are formed in the end walls 51 and 52 and individual intermediate walls 55. The end walls 51 and 52 and side walls 53 and 54 extend above the plane of the intermediate walls 55. This forms an overlying recess in the base unit to accept the cover-actuator 23 shown in FIG. 2.

Figure 3:
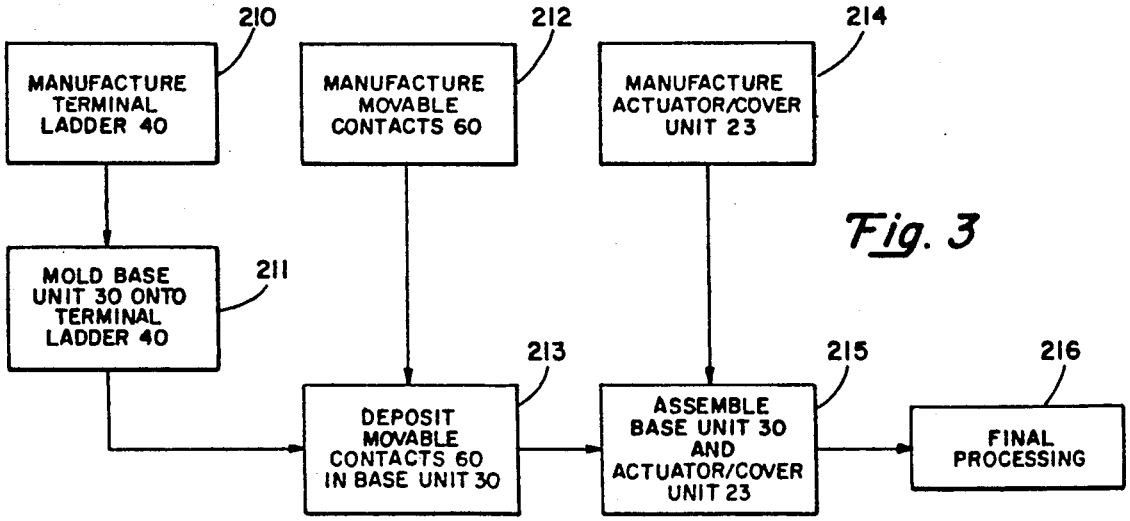
FIG. 3 is a block diagram illustrating the manufacturing sequence for construction the electrical switching device of FIGS. 1 and 2.

A movable contact 60 shown in FIG. 2 constitutes a second component set and its manufacture is represented by step 212 in FIG. 3. Referring to FIGS. 2, 7 and 8, the contacts 60 are initially received as stamped individual contacts extending from a carrier 61. Each contact 60 is carried at the free end of an intermediate link 62 cantilevered from the carrier 61. The contact 60, as inserted in FIG. 2, begins at a radius 63 shown in FIGS. 7 and 8. The contact material bends across a median plane represented by an axis 64 and forms a link 65 between the radius 63 and a second radius 66. Next the terminal ends back toward the median plane 64 and forms a link 67 to a radius 70 so a next link 71 carries back to the median plane 64. Another radius 72 produces a link 73 essentially in the median plane 64. A following radius 74 then bends the contact back down so a link 75 is directed below the median plane 64. This link 75 terminates in a short radius 76. FIG. 8 depicts a modification that extends the movable contact 60 beyond the radius 76 with a short upward extension 77. Ears 78 and 79 extend transversely from the link 67. These ears 78 and 79 register with the slots 34 and 36 in FIG. 2 to position the movable contact 60 within each individual cavity 31.

Referring to FIGS. 2 and 7, a central elongated slot 150 is stamped into the movable contact 60. This slot 150 is coextensive with a portion of the link 65, the link 67 and a portion of the link 71. The length and width of the slot 150 control the spring forces that the movable contact 60 generates. Moreover, the link 75 (and the extension 77 in FIG. 8) are bifurcated. A resulting slot 151 formed between the fingers 75*a* and 75*b* controls the forces exerted by and deflection of the fingers 75*a* and 75*b*.

Still referring to FIGS. 2 and 7, the contact from the carrier shown in FIG. 7 are severed at approximately the radius 63. This constitutes a first end portion that is captured in the switch cavity as described later. The radius portions 66 and 70 are intermediate link 67 constitute a first intermediate portion that constantly bears against the stationary terminal 45 shown in FIG. 4. The radius 72 between the portions 71 and 73 constitutes a cam follower that coacts with a corresponding actuator, such as an actuator 24 or 25 in FIG. 1. The radius 76 and, in FIG. 8 the extension 77, constitute a second end portion that switches into electrical contact with the stationary contact 44 shown in FIG. 4.

During the manufacturing step 212 in FIG. 3, the movable contacts 60 shown in FIGS. 2, 7 and 8 are stamped from a spring material such as beryllium copper so that the normal position is shown as in FIG. 7. As described later, in this position the second end portion (i.e., the radius portion 76) is spaced from the stationary contact 44 shown in FIG. 4. In the manufacturing step 213 of FIG. 3, the individual components are deposited into individual cavities 31. As shown in FIG. 2, the ears 78 and 79 properly align the movable contacts 60 within the cavities 31.

Step 214 in FIG. 3 represents the manufacture of the actuator-cover unit 23 of FIGS. 1 and 2. FIG. 9 shows a cover-actuator 23 of arbitrary length. Again a sixteen-position cover-actuator is typical. Two pole planes represented along two sets of axes 26*a*–27*a* and 26*b*–27*b* are also shown in FIGS. 9 and 11.

The cover-actuator 23 is manufactured by a double injection molding. The primary molding operation forms the actuators 25. Specifically, the primary mold includes cavities for the total number of actuators to be formed in a given cover. That is, if the cover-actuators are to include sixteen poles, then the primary mold has cavities for sixteen actuators. The cavity spacing would correspond to the final position of the actuators 25 in the final cover-actuator 23.

Referring specifically to FIG. 10, each actuator 25 comprises a generally U-shaped body portion 81 with tool wells 80. A radial extension 82 from the lower portion of the body 81, as shown in FIG. 10, has parallel sides 83 and 84 that terminate in a transverse plane 85 extending partially across the extension 82. Referring to FIGS. 10 and 11, a cam 86 also extends from the extension 82 and is off center from the extension 82. The cam 86 has a pointed cam surface 87.

Once the actuators 25 are molded, the secondary molding operation produces the cover portion formed about the actuators. As shown in FIGS. 9 through 11 the cover 23 includes an upper surface portion 90 overhanging a section 91 that fits inside the base unit 30 as shown in FIG. 2. Still referring to FIGS. 9 through 11, a body portion 92 is tapered inwardly to a contiguous portion 93. The body portion 92 has an internal stop surface 94 and a vertical offset surface 95. In addition it contains a stop surface 96 and a downwardly extending boss 97. Energy directors 100 are shown intermediate the pole planes represented by axes 26 and 27 in FIG. 11. These energy directors 100 enable the material in the cover-actuator 23 intermediate the poles to be ultrasonically welded to the intermediate wall portions 55 shown in FIGS. 4, 5 and 6.

Referring to FIGS. 9 and 10, the secondary molding position also produces a journal 101 that is integral with the ends 102 and 103 of the cover 23 and that forms a bearing surface for a bearing surface 104 molded in the actuator 25 during the primary molding operation.

Thus, it will be apparent that molding the actuators 25 and cover 23 in situ eliminates an assembly operation.

The actuator 25, which is coated with a release agent during the secondary molding operation, can rotate freely inside the cover 23 over a limited range. A first limit, as shown in FIG. 10, is defined when the edge 83 contacts the stop surface 96. The actuator 25 can rotate counter-clockwise until the edge 84 contacts the stop surface 94. This is the second limit. During such rotation the cam 86 also rotates counter-clockwise and, because it is offset, the cam surface 87 moves to the right through an arcuate path.

Referring again to FIG. 3, the manufacture is completed during an assembly step 215 when the cover-actuator 25 shown in FIGS. 9 and 10 is positioned on the base unit 30 shown in FIG. 2 base unit with the movable contacts 60 in place. As this occurs, the bosses 97 on the cover-actuator 23 engage the first end portions 63 of the movable contacts 60 and fix them in place. Once positioned, ultrasonic welding affixes the cover-actuator 25 to the base unit 30 and produces individual switching cavities for each pole. Once the switch is assembled and ultrasonically welded, trimming operations and other final processing shown in step 216 is used to cut the terminals 21 and 22 to length, bend them into position, and remove extraneous material such as webs 120 that interconnect the terminals 44 and 45 as shown in FIG. 4.

Thus, it will be seen that the structure, shown particularly in FIGS. 1 and 2, is manufactured with a reduced number of components. The three major components are automatically produced and can be readily assembled thereby simplifying the manufacturing process. Moreover, the switch, as stated, can be cut into independent switching elements with an arbitrary number of poles. Specifically, individual switching cavities 31 are separated by the intermediate wall portions 55 shown in FIGS. 4 through 6 and corresponding material from the cover. These wall portions 55 are approximately twice as thick as the end walls 50 and 51. After ultrasonic welding, the walls 55 completely isolate adjacent cavities from one another. Thus, when a sixteen-pole unit is sliced between the fourth and fifth poles, one DIP switch as shown in FIG. 2 results and a second, twelve-pole DIP switch remains.

FIGS. 12 and 13 are enlarged cross-sections of a pole in the switch shown in FIG. 1 in the "off" and "on" positions respectively. In the "off" position the pushbuttons **25*a* and 25*b* are flush with the top surface of the cover-actuator 23. The boss 97 captures the first end 63 of the contact 60 by riding on the portion 65. The slopes of the link 65 and boss 97 put downward pressure on the contact 60 so the link 67 is in firm contact with the stationary contact 45. In this position the cam surface 87 on the actuator 25 is to the left of the radius 72, so the end 76 is spaced from the contact 44. Thus, there is no connection between terminals in the rows 21 and 22**.

When a force is applied to the push button **25*a*, the actuator 25 rotates counter-clockwise to the position shown in FIG. 13. During the transition, the cam 86 and cam surface 87 rotate counter-clockwise engaging the link 71 and forcing it toward the base 50 and the terminal 21. This tends to flaten the contact 60 and introduces internal stresses into the beryllium copper structure. As the end of the cam 86 passes over the radius 72, the end 87 of the cam 86 begins to translate toward the cover 23 and away from the base plate 50. This allows the spring material of the contact 60 to relax. In this position the link 73 is angled downwardly toward the contact 44 and the relationship of the contact 60 and cam 86 are such that the second end of the movable contact is in a firm connection with the stationary contact 44. When the edge 84 reaches the stop surface 94, the actuator 25 is in the position shown in FIG. 13. As the cam 86 traverses the radius 72, the ability of the spring material to relax and the relative configuration of the contact 60 and cam 86 provide a detent action while maintaining the electrical connection between the contacts 60 and 44**.

To open the switch, that is to return it to the position shown in FIG. 12, a force is applied to the surface of the push button **25*b*. The cam surface 87 rides up along the link 73 of the spring contact 60 and pass over the radius 72. At that point the restoring force from the spring material snaps the contact 60 back to the position shown in FIG. 12** and produces a detent action.

An alternate construction of the switch shown in FIG. 1 and particularly the cover-actuator shown in FIGS. 9 through 11 is disclosed in FIG. 14 and 15. Whereas the operative surfaces **25*a* and 25*b* are completely surrounded by the cover 23 in FIGS. 9 through 11, the cover-actuator shown in FIGS. 14 and 15 is formed as a "piano keyboard" switch. Referring specifically to FIG. 14, the cover-actuator 123 includes a cover portion 124 and a plurality of actuators such as an actuator 125. The structure of the actuator 125 corresponds to that shown in FIG. 10. That is the surface 125*b* corresponds to the surface of push button 25*b* shown in FIG. 10. However, the surface 125*a* is elongated and terminates at the edge of the cover 123. As shown in FIG. 15, the actuator 125 is in the "off" position. In this case that actuator position is determined by a section 126 interfering with a surface 127 on a portion 191 corresponding to the portion 91 in FIG. 10. When force is applied to the surface 125*b*, the actuator 125 rotates about a journal 101 until surfaces 184 and 194, that correspond to surfaces 84 and 94 in the actuator FIG. 10, contact. A boss 197 and cam 186 perform functions corresponding to those performed by the boss 97 and cam 86 in FIG. 10**.

In accordance with this invention there has been disclosed a switching mechanism that can be constructed with an arbitrary number of poles. Such a switch then can e cut to provide a component with a required specific number of poles such as two, four or eight poles. Thus, manufacturing the switch is limited to a single production of a switch with the arbitrarily selected number of poles such as sixteen poles. This reduces the number of different components that are required, and the inventories of components and finished products that must be kept on hand. Orders are then filled by merely taking finished switches and cutting them to the proper size. It will also be apparent that with this construction it is possible to stack these switches end to end because the end walls 51 and 52 are approximately half the width of the intermediate walls 55 shown in FIG. 4. Moreover, the terminal spacing between adjacent switch blocks remains constant.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed as new and desired to be secured by Letters of the U.S. Pat. is:

1. A method for constructing a multiple pole switch of the dual in-line package type comprising the steps of:

A. manufacturing a base unit with a predetermined plurality of terminal means aligned along a plurality of parallel pole planes, said manufacturing producing a cavity in the base unit for each terminal means, B. manufacturing movable contacts having first and second end portions and first and second intermediate portions, C. depositing each of the movable contacts produced by said movable contact manufacturing step into a corresponding cavity, D. double injection molding a cover actuator including the steps of a primary molding of a rotatable actuator and secondary molding of a cover capturing said actuator for limited rotation therein, and E. assembling said cover onto said base unit thereby to capture said movable contacts in the corresponding cavities with the first intermediate portion of each said contact means being held against a corresponding terminal means.

2. A method for forming an electrical switch as recited in claim 1 wherein said base unit manufacturing step includes:

(1) manufacturing a terminal ladder comprising parallel carrier strips and transversely extending sets of spaced terminal strips, and (2) molding said terminal ladders into a base unit with intermediate walls between adjacent terminal strips thereby to define cavities centered on each terminal set.

3. A method for constructing an electrical switch as recited in claim 2 wherein said terminal ladder is manufactured by stamping an additionally comprises the steps of plating first and second selected portions of said terminal strips.

4. A method as recited in claim 1 wherein said manufacturing steps produce a multiple pole switch with an arbitrary number of poles, said method additionally comprising the step of severing said multiple pole switch at a position between adjacent pole planes thereby to produce a switch having a fewer number of switching poles.

* * * * *